United States Patent [19]

Bindhoff

[11] Patent Number: 4,476,074

[45] Date of Patent: Oct. 9, 1984

[54] METHOD AND APPARATUS FOR FORMING CAST-IN-PLACE STRUCTURES

[75] Inventor: Eduardo W. Bindhoff, Fairview Park, Ohio

[73] Assignee: Intrusion-Prepakt Incorporated, Cleveland, Ohio

[21] Appl. No.: 436,328

[22] Filed: Oct. 25, 1982

Related U.S. Application Data

[62] Division of Ser. No. 226,107, Jan. 19, 1981, Pat. No. 4,385,648.

[51] Int. Cl.[3] ..... E04B 1/16; E04G 13/00

[52] U.S. Cl. ..... 264/35; 249/15; 249/19; 264/257; 405/19; 405/284

[58] Field of Search ..... 264/35, 86, 257; 405/19, 216, 258, 284; 249/15, 19

[56] References Cited

U.S. PATENT DOCUMENTS

| | | | |
|---|---|---|---|
| Re. 27,460 | 8/1972 | Lamberton | 264/86 |
| 2,562,299 | 7/1951 | Crouch | 264/35 |
| 2,754,855 | 7/1956 | Foley | 139/384 |
| 2,888,958 | 6/1959 | Lilley | 139/390 |
| 3,326,005 | 6/1967 | Jacobs | 61/37 |
| 3,396,545 | 8/1968 | Lamberton | 61/47 |
| 3,425,227 | 2/1969 | Hillen | 61/38 |
| 3,425,228 | 2/1969 | Lamberton | 61/38 |
| 3,524,320 | 8/1970 | Turzillo | 61/38 |
| 3,555,751 | 1/1971 | Thorgusen | 264/35 |
| 3,565,125 | 2/1971 | Hayes, et al. | 139/384 |
| 3,708,146 | 1/1973 | Lamberton | 249/1 |
| 3,711,627 | 1/1973 | Maringulov | 174/68.5 |
| 3,726,950 | 4/1973 | Turzillo | 264/32 |
| 3,811,287 | 5/1974 | Winter | 61/38 |
| 4,154,061 | 5/1979 | Umemoto | 405/19 |

FOREIGN PATENT DOCUMENTS

| | | |
|---|---|---|
| 2320801 | 11/1974 | Fed. Rep. of Germany . |
| 2217970 | 9/1974 | France . |
| 55-72516 | 5/1980 | Japan . |

*Primary Examiner*—Jay H. Woo
*Assistant Examiner*—James C. Housel
*Attorney, Agent, or Firm*—Yount & Tarolli

[57] ABSTRACT

An improved method and apparatus for forming cast-in-place structures includes the use of a sheet of fabric having a plurality of pockets for receiving support rods. The pockets are formed between an inner side surface of the sheet of fabric and a plurality of strands of material. The support rods are used to hold the fabric in place while a slurry of a cementitious material is poured into a cavity between the sheet of fabric and a base. The cementitious slurry flows between the strands of material into the support rod receiving pockets. The resulting concrete structure extends around the support rods to prevent them from being exposed to the environment. The strands of material are advantageously connected with the sheet of fabric by interweaving them with the threads of the fabric.

11 Claims, 10 Drawing Figures

METHOD AND APPARATUS FOR FORMING CAST-IN-PLACE STRUCTURES

This is a division of application Ser. No. 226,107, filed Jan. 19, 1981, now U.S. Pat. No. 4,385,648 issued May 31, 1983.

BACKGROUND OF THE INVENTION

This invention relates to a method and apparatus which uses a sheet of fabric to hold a cementitious slurry during casting of a concrete structure.

Fabric containers have previously been used to hold cementitious slurry during the forming of a cast-in-place concrete structure. These fabric containers have been supported by tubular frameworks which engage the outer side surface of the fabric and are disposed outside of the resulting concrete structure. Upon solidification of the slurry, the outside framework is removed. The forming of concrete structures in this manner is disclosed in U.S. Pat. No. 3,726,950.

The aforementioned patent also discloses the use of support structures which are disposed on the inside of a slurry receiving cavity defined by the fabric. When inside supports are used, wire or other tension-restraining tie-elements extend through the sheet of fabric to hold the fabric in place relative to the support structure. Since the wire tie-elements extend through the fabric sheet, they project outwardly from the resulting concrete structure and provide a path for corrosion. In addition, the tie elements may tend to concentrate stresses in the sheet and weaken the sheet.

SUMMARY OF THE PRESENT INVENTION

The present invention provides a new and improved method of forming cast-in-place concrete structures. The concrete is cast in containers which are at least partially formed of fabric without providing support structures on the outside of the fabric and without piercing the fabric. The resulting concrete structure is free of exposed metal frame members which provide a path for accelerated corrosive attack on the structure.

When an improved concrete structure is to be cast in accordance with the present invention, support rods are inserted in pockets in a sheet of fabric. The pockets are formed between an inner side surface of the sheet of fabric and strands of material which extend along the inner side surface of the fabric. The support rods are connected with outer end portions of support elements which extend between the strands of material into the rod receiving pockets.

As a cementitious slurry is poured into a cavity which is at least partially defined by the sheet of fabric, the slurry flows between the strands of material into the pockets. The cementitious slurry presses the sheet of fabric outwardly away from the support rods so that the support rods are surrounded by the slurry. This results in the support rods being enclosed by concrete when the slurry hardens. Since the support rods are enclosed by concrete, they are protected against corrosive attack by seawater and/or other environmental elements.

The strands of material which cooperate with the sheet of fabric to define the rod receiving pockets are advantageously interwoven with the warp and/or weft threads of the sheet of fabric. This results in tension forces which are applied against the strands of material by the support rods being transmitted to a relatively large area of the sheet of fabric. The strands of material extend for a substantial distance along the inner side surface of the sheet of fabric to enable the sheet of fabric to be moved outwardly away from the support rods under the influence of pressure applied against the fabric by the slurry of cementitious material.

Accordingly, it is an object of this invention to provide a new and improved method and apparatus for casting concrete structures by using a sheet of fabric to hold a cementitious slurry and wherein the sheet of fabric is supported by rods disposed in pockets, the pockets being located along an inner side of the sheet of fabric and constructed so as to enable the slurry to enter the pockets.

Another object of this invention is to provide a new and improved method and apparatus as set forth in the next preceding object and wherein the support rods are embedded in the concrete structure which is formed upon hardening of the cementitious slurry.

Another object of this invention is to provide a new and improved method and apparatus as set forth in any of the preceding objects and wherein the rod receiving pockets are partially defined by a plurality of strands of material which extend along an inner side surface of the sheet of fabric.

BRIEF DESCRIPTION OF THE DRAWINGS

The foregoing and other objects and features of the present invention will become more apparent upon a consideration of the following description taken in connection with the accompanying drawings and wherein.

DESCRIPTION OF ONE SPECIFIC PREFERRED EMBODIMENT OF THE INVENTION

Cast Concrete Structure

Figure 1:
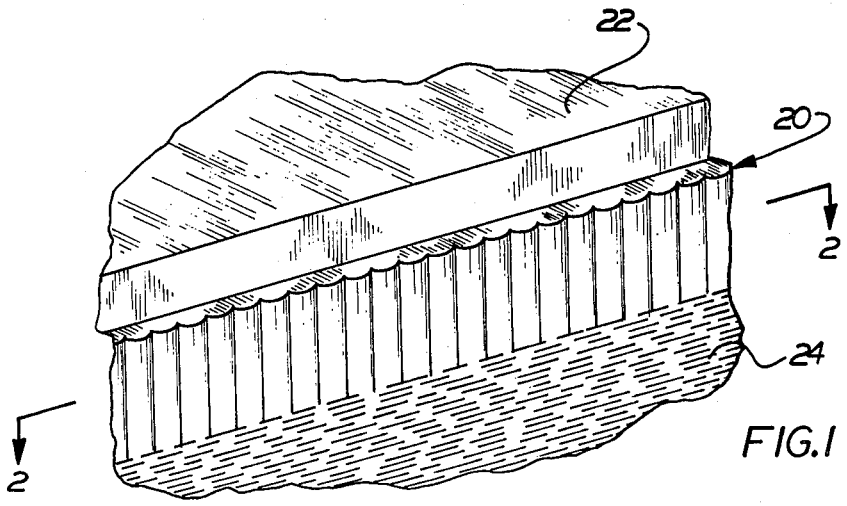
FIG. 1 is a schematic illustration of an example of one of many types of concrete structures which can be formed with the method and apparatus of the present invention.

Although it is contemplated that the method and apparatus of the present invention will be used to cast many different types of structures, a cast concrete structure 20 constructed in accordance with the present invention is illustrated in FIG. 1 in association with a pier or dock 22 which forms a base for the concrete structure. The concrete structure 20 extends to the bottom of the pier 22 and protects the side of the pier from the seawater 24. It is contemplated that the concrete structure 20 will be formed in association with either existing bases to repair environmental damage or be provided in association with original construction in order to prevent environmental damage.

In accordance with a feature of the present invention, the concrete structure 20 is free of metal components which are exposed to the environment. This eliminates paths along which corrosion can enter the concrete structure 20. Thus, if a metal component extended from the concrete structure 20 and was exposed to the seawater 24, corrosion of the metal component would proceed relatively quickly. The corrosion would enter and weaken the structure 20.

Figure 2:
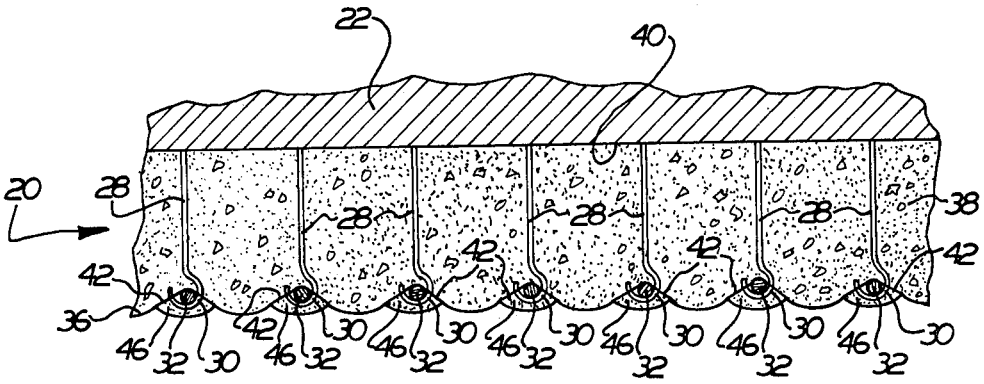
FIG. 2 is a sectional view, taken generally along the line 2—2 of FIG. 1, and illustrating the relationship between a base upon which the concrete structure is disposed, a plurality of support elements which extend outwardly from the base, and a plurality of support rods which are connected with outer end portions of the support elements.
Figure 3:
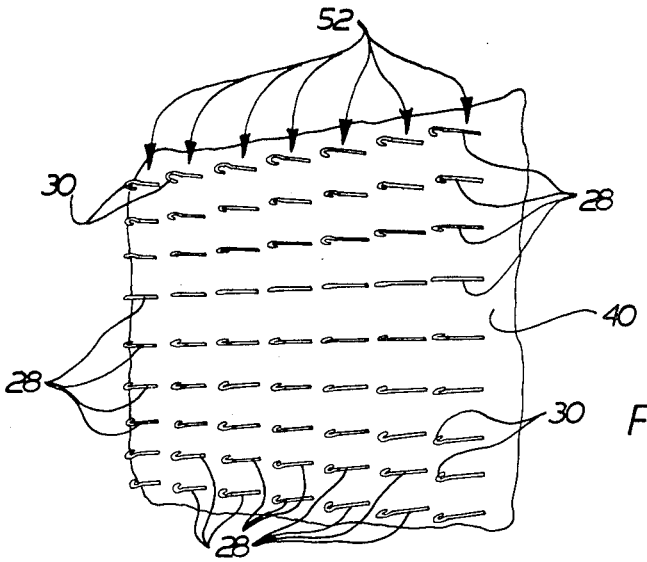
FIG. 3 is a fragmentary illustration of the base and support elements of FIG. 2 prior to formation of the concrete structure.

The concrete structure 20 (see FIG. 2) includes a plurality of rigid metal support elements or bars 28 which extend horizontally outwardly from the base 22 and are disposed in vertical linear arrays (FIG. 3). The horizontal support elements 28 have hook-shaped outer end portions 30 (FIG. 2) which are connected with straight rigid metal support rods or bars 32. Each of the vertical support rods 32 is connected to the outer end portions 30 of support elements 28 disposed in a single vertical array.

A sheet 36 of fabric is disposed on a scalloped outer side surface of a body 38 of concrete which engages an outer side surface 40 on the base 22. Strands or elongated pieces of material 42 cooperate with the sheet 36 of material to define elongated vertical pockets 46 in which the support rods 32 are disposed. Although the fabric sheet 36 has been shown in place on the outside of the concrete structure 20, it is contemplated that the sheet could be removed if desired.

The body 38 of concrete is cast in place between the sheet 36 of fabric and the base 22. The body of concrete extends between the strands 42 of material into the rod receiving pockets 46. Therefore, the support rods 32 are embedded in concrete and are not exposed to the seawater 24 (see FIG. 1).

The fabric 36 (FIG. 2) is not perforated by either the support elements 28 or the support rods 32. Therefore, the metal support elements 28 and support rods 32 are encased by the concrete. The concrete protects the steel support elements 28 and rods 32 from corrosion due to the seawater 24 and other environmental factors. It should be understood that the structure 20 could be an independent structure separate from any pre-existing structure. Thus, the base for the structure 20 could merely be a few frame members.

Support Elements

The steel support elements or bars 28 are disposed in a plurality of vertical linear arrays 52 (see FIG. 3). The arrays 52 of support elements each receive one of the steel support rods 32 (FIG. 2) to support the fabric sheet 36. In addition to supporting the fabric sheet 36, the support elements 28 and rods 32 reinforce the concrete 38.

Each of the support elements 28 includes a hooked shaped outer end portion 30 (see FIG. 4) and a straight shank portion 56. The shank portion 56 extends outwardly from the base 22 in a direction perpendicular to a vertical side surface 40 of the base. The support elements 28 are spaced equal vertical distances apart in the arrays 52 and the arrays are spaced equal horizontal distances apart. If desired, horizontal reinforcing bars could be connected with the shank portions 56 of the support elements 28.

The shank portions 56 of each of the support elements 28 is connected with the base 22. The manner in which each shank 56 is connected with the base 22 will depend upon the material from which the base is formed. For example, if the support elements 28 are connected with a solid metal base 22, the shanks 56 can be welded directly to the base. If the base is formed of relatively thin sheet material which due to corrosion or other causes cannot provide a solid support for the elements 28, the shanks 56 of the elements could be connected to plates or bars which would in turn be connected to the base. If the base 22 is concrete, the support elements 28 can be grouted into holes drilled into the concrete or connected to wedge bolts or anchors fastened into the concrete.

Mounting of Fabric Sheet

Figure 4:
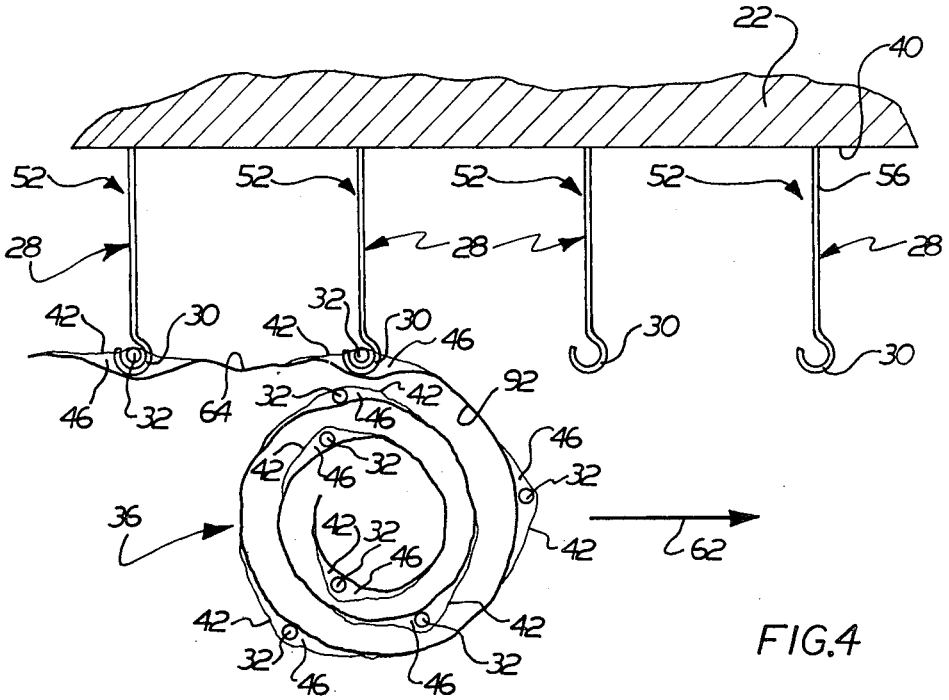
FIG. 4 is a schematic illustration depicting the manner in which support rods disposed in pockets in a sheet of fabric are connected with outer end portions of the support elements of FIG. 3.

Prior to connecting the fabric sheet 36 with the vertical arrays 52 of support elements 28, the rigid metal support rods 32 are positioned in the pockets 46 and the sheet is rolled up (see FIG. 4). The strands 42 which partially define the rod receiving pockets 46, face radially outwardly of the rolled sheet 36. The rolled sheet 36 with the straight rods 32 in the pockets 46 is then lowered into position along the base 22. The rolled sheet 36 can be lowered into the water 24 by a derrick or similar device. It is contemplated that divers will be used in handling the rolled sheet 36.

Once the rolled sheet 36 has been lowered adjacent to the support elements 28, the sheet is unrolled and connected with the support elements. Thus, the support rod 32 adjacent to one end of the sheet 36 is connected with the first or leftward (as viewed in FIG. 4) vertical array 52 of support elements 28. As the sheet 36 is unrolled, the succeeding support rods 32 are sequentially connected with the succeeding vertical arrays 52 of support elements 28.

The first or leftward (as viewed in FIG. 4) support rod 32 is connected with the support elements 28 by aligning the support rod with the first or leftward vertical array 52 of support elements. The first support rod 32 is then moved adjacent to the hook shaped end portions 30 of the first vertical array 52 of support elements. As this occurs, the hook shaped outer end portions 30 of the first array 52 of support elements 28 pass between the strands 42 and enter the support rod receiving pocket 46. After the outer end portions 30 of the support elements 28 have passed between the strands 42 and entered the pocket 46, the support rod 32 is moved through the bites or open portions of the hook shaped ends 30 and positioned relative to the first vertical array of support elements 28. It is contemplated that the fabric sheet 36 and support rod 32 will be held in vertical alignment with the array of support elements 28 by a support frame (not shown) or by resting on the ground or a suitable base.

When the first or leftward support rod 32 (see FIG. 4) has been connected with the first or leftward array 52 of support elements 28, the rolled sheet of fabric 36 is uncoiled as it is moved toward the right (as viewed in FIG. 4) in the direction of the arrow 62. As the sheet of fabric 36 is unrolled, the next succeeding pocket 46 and support rod 32 is moved into alignment with the next succeeding vertical array 52 of support elements 28. The second pocket 46 is then moved toward the base 40. The outer end portions 30 of the second array 52 of support elements 28 enter the pocket 46 between the strands 42 and engage the second support rod 32.

Once the second support rod has been connected with the second array of support elements 28, the sheet is unrolled and the next succeeding support rod 32 is connected with the next succeeding array 52 of support elements. These steps are repeated until the fabric sheet 36 is completely unrolled and all of the support rods 32 have been connected with the support elements 28.

Figure 5:
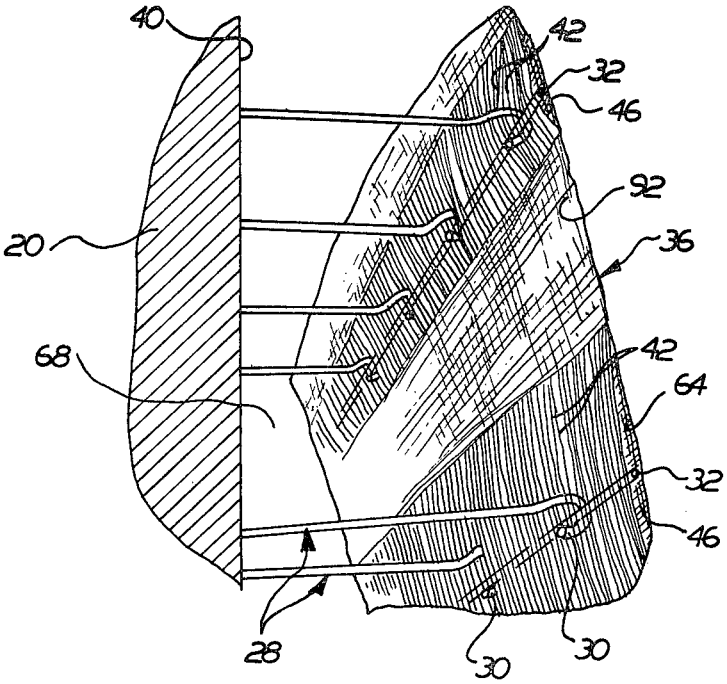
FIG. 5 is a fragmentary perspective view illustrating the manner in which the outer end portions of the support elements extend into the pockets in which the support rods are disposed.
Figure 6:
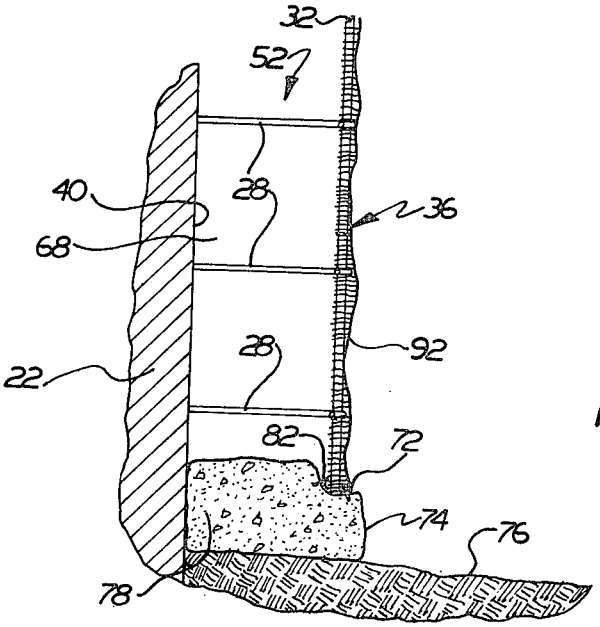
FIG. 6 is a fragmentary sectional view illustrating one way in which a lower end portion of the sheet of fabric can be anchored.

Once the support rods 32 and support elements have been interconnected, the fabric sheet 36 and the strands 42 of material loosely engage the support rods 32 in the manner shown in FIGS. 5 and 6. Thus, an inner side surface 64 (FIG. 5) of the fabric sheet 36 lays against the support rods 32 and the outer end portions 30 of the support elements 28. The fabric sheet 36 is held against floating away from the support rods 32 by the strands 42 of material which cooperate with the inner side surface 64 of the fabric sheet 36 to define the support rod receiving pockets 46. When the fabric sheet is in this position, a vertically extending cavity 68 is formed between the outer side surface 40 of the base or pier 22 and the inner side surface 64 of the sheet 36. Suitable end pieces (not shown) are positioned between the fabric sheet 36 and the pier 22 to close off the ends of the cavity 68. It should be noted that the majority of the cavity 68 is filled with seawater which has been omitted from FIGS. 5 and 6 for purposes of clarity of illustration.

The upper end portion of the fabric sheet 36 can be hung on the upper row of support elements 28 if desired. However, it is preferred to provide a hem, i.e., a longitudinally extending pocket, in the upper end portion of the fabric sheet 36. As the sheet is unrolled, a support rod is inserted into the hem.

The lower end portion 72 (FIG. 6) of the fabric sheet 36 is advantageously connected with an anchor bag 74. The anchor bag 74 lays on the bottom 76 of the ocean or other body of water and abuttingly engages the base or pier 22. Once the sheet 36 has been placed relative to the support elements 28, the anchor bag is filled with a cementitious slurry in a manner similar to that described in U.S. Pat. No. 3,524,320. The cementitious slurry solidifies to form a solid body 78 of concrete.

The lower end portions of the support rods 32 are received in a horizontal pocket 82 formed at the lower end of the fabric sheet 36 at a connection between the fabric sheet 36 and the anchor bag 74. The horizontal pocket 82 provides support for the rods 32 as the fabric sheet 36 is uncoiled (see FIG. 4). The pocket 82 is attached to the anchor bag 74.

Although a particular anchor arrangement has been shown in FIG. 6 for the fabric sheet 36 and support rods 32, it is contemplated that many different anchor arrangements could be used if desired. It is contemplated that the type of anchor arrangement used will, probably, vary with variations in the environment in which the fabric sheet 36 is used. In fact it is contemplated that the fabric sheet 36 could be used on dry land if desired.

Pouring Concrete

Once the fabric sheet 36 has been positioned relative to the support elements 28 and anchored in place, the cavity 68 between the outer side surface 58 of the base 40 and the inner side surface 64 of the fabric sheet 36 is filled. The cavity 68 is filled with a cementitious slurry 86 (see FIG. 7). Although the cavity 68 could be filled with only the slurry 86, it is contemplated that a clean coarse graded aggregate, i.e., small rocks, will be placed in the cavity first and the slurry 86 pumped into the voids.

The cementitious slurry 86 flows into the cavity 68 through a suitable pipe or conduit (not shown). The cementitious slurry 86 fills the cavity 68 from the anchor bag 74 upwardly. Thus, the slurry pipe or conduit is positioned with its open end adjacent to the anchor bag 74 and is gradually withdrawn from the cavity 68 as the cavity fills with the slurry. As the cementitious slurry 86 fills the cavity 68, the slurry flows between the strands 42 of material and enters the rod receiving pockets 46 (see FIG. 8).

As the cementitious slurry flows between the strands 42 into the pockets 46, the slurry presses against the inner side surface 64 of the fabric sheet 36. This pressure causes the fabric sheet 36 to move outwardly, that is in a direction away from the base 22. As the fabric sheet 36 moves outwardly away from the base 22, the strands 42 of material are tensioned around the vertically extending support rod 32 (see FIG. 8). The tension forces applied to the support rod 32 are transmitted to the support elements 28 by the interconnection between the support rod 32 and support elements 28 at the hook shaped outer end portions 30 of the support elements 28.

The fabric sheet 36 is supported by the rods 32 and support elements 28 which are disposed adjacent to the inner side surface 64 of the fabric sheet. The outer side surface 92 of the fabric sheet 36 is free of engagement with support structures. Therefore, the fabric sheet is free to bulge outwardly away from the support rods 30 in the manner shown in FIG. 8. This results in the pocket 46 becoming filled with slurry which flows into the pocket between the strands 42. Thus, the pressure of the cementitious slurry 86 in the rod receiving pocket 46 moves the sheet of fabric 36 outwardly away from the support rod 32 so that the support rod is surrounded by the cementitious slurry.

Due to the fact that the cementitious slurry completely surrounds the support rod 32 and the support element 28, when the slurry hardens, the support rod 32 and support element 28 are embedded in the body of concrete 38 (FIG. 2). The portion of the body of the concrete which 38 is disposed outwardly of the support rod 32 and the outer end portion 30 of the support element 28 protects them from exposure to the elements of the environment around the concrete structure 20. However, if the fabric sheet 36 remained in abutting engagement with the support rods 32 and was not moved outwardly away from the support rods by the pressure of the slurry against the sheet, the support rods would be exposed to the corrosive effects of the seawater 24. The relatively rapid corrosion of the metal support rods 32 would lead to deterioration of the concrete structure 20 in a relatively short time.

Figure 7:
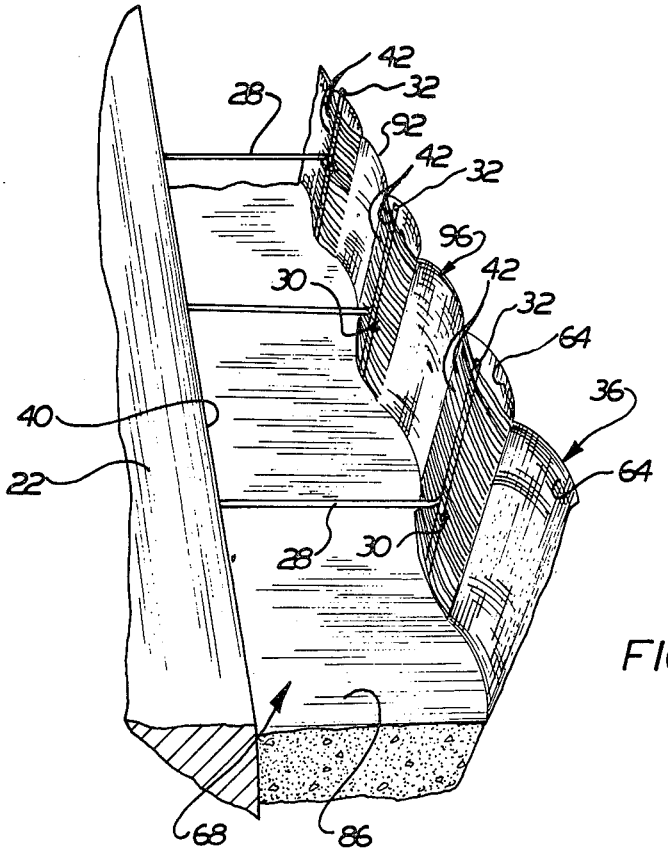
FIG. 7 is a fragmentary perspective view illustrating the manner in which a cementitious slurry is held in a cavity formed between the sheet of fabric and the base.
Figure 8:
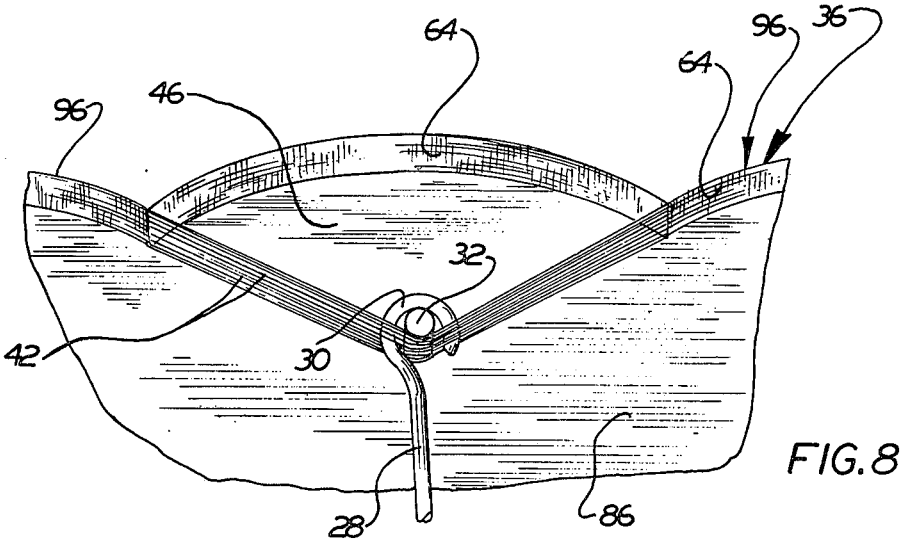
FIG. 8 is a fragmentary illustration depicting the manner in which the cementitious slurry enters a support rod receiving pocket and presses the fabric outwardly away from the support rod.

In addition to preventing exposure of the support rods 32 and support element 28 to the environment, supporting the fabric sheet on the support rods and support elements in the manner shown in FIGS. 7 and 8 eliminates the necessity to perforate the fabric sheet with metal rods or ties. Since the fabric sheet 36 is not perforated with metal rods or ties, the strength of the sheet is not impaired so that it can withstand relatively high hydrostatic pressures resulting from the casting of concrete structures which extend upwardly a substantial distance from a base. In addition, since the fabric sheet 36 is not perforated by a support element, support elements do not project outwardly of the resulting concrete structure 20 to provide a path for corrosion to enter the structure.

Sheet of Fabric

The fabric sheet 36 has elongated pockets 46 (see FIGS. 5 and 7) in which the support rods 32 are disposed. The straight elongated pockets 46 extend from the upper edge of the sheet 36 to the lower edge of the sheet. Disposed between the pockets 46 are elongated connector panels 96 (FIGS. 5 and 7). The connector panels 96 also extend between the upper and lower edge portions of the fabric sheet 36. The connector panels 96 and pockets 46 have parallel vertical longitudinal central axes. The width of the pocket sections 46 and the width of the panel sections 96 remain constant throughout the length of the sheet of fabric 36. Both the pockets 46 and the panel sections 96 are bulged outwardly under the influence of the pressure applied against the fabric sheet 36 by the cementitious slurry 86.

In one specific preferred embodiment of the invention, the width of the pockets 46 and the panels 96 between the pockets were equal. Thus, the pockets 46, in this particular embodiment of the invention, had a width of nine inches. The panel sections 96 also had a width of nine inches. Of course, the pockets 46 and panel sections 96 could have widths other than nine inches and the width of the pocket sections would not have to be the same as the width of the panel sections. The foregoing specific dimensions of the pocket and panel sections are provided for clarity of description and are not intended to limit the invention.

The strands or elongated pieces of material 42 are advantageously interwoven with the warp and weft threads of the fabric sheet 36. By interweaving the strands 42 with the threads of the fabric sheet 36, the tension forces applied against the strands 42 are transmitted to a relatively large area of the fabric sheet 36 to provide a strong interconnection between the strands 42 and the fabric sheet. Interweaving the strands 42 with the threads of the fabric sheet 36 provides a strong joint between this fabric sheet and the strands. This minimizes the possibility of the fabric sheet 36 tearing. In addition, interweaving the strands 42 with the threads of the fabric sheet 36 eliminates the necessity of positioning individual strands relative to each other and then connecting them with the fabric sheet in order to form the pockets 46.

Figure 9:
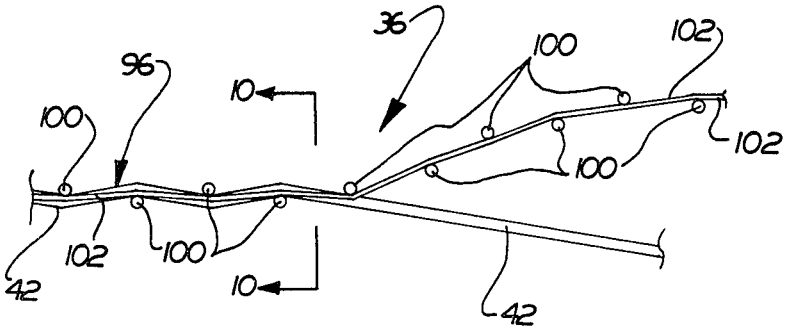
FIG. 9 is a schematic illustration depicting the manner in which pocket forming strands of material are interwoven with warp and weft threads of the sheet of fabric.
Figure 10:
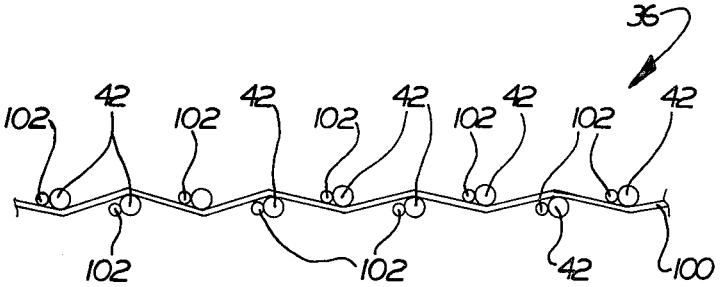
FIG. 10 is a sectional view, taken generally along the line 10—10 of FIG. 9, further illustrating the manner in which the strands of material are interwoven with the warp and weft threads of the sheet of fabric.

The fabric sheet 36 has vertically extending weft threads 100 (see FIGS. 9 and 10). The weft threads 100 extend between the upper and lower edges of the fabric sheet and extend parallel to the longitudinal central axes of the pockets 46 and panel sections 96. The warp threads 102 extend horizontally between vertical side edges of the sheet 36. The warp threads 102 extend perpendicular to the weft threads 100 and the longitudinal central axes of the rod receiving pockets 46. Each of the warp threads 102 extends across each of the rod receiving pockets 46.

In one specific embodiment of the invention, the weft contained 14 picks per inch of 4000 denier textured multifilament nylon yarns. In this particular embodiment of the invention the warp contained 20 ends per inch of 1260 denier multifilament nylon yarn. Of course, the warp and weft threads could be formed of yarns of different strengths and of different spacings. In addition, the orientation of the warp and weft threads could be changed if desired.

The strands 42 are interwoven with the warp and weft threads 100 and 102 of the fabric sheet 36. Thus, the strands 42 extend between the weft threads 100 and the warp threads 102 in the manner shown in FIG. 9. This results in a strand of material 42 being placed adjacent to each of the warp threads 102 in the manner shown in FIG. 10 and interconnected by the weft threads 100. The strand 42 could be placed adjacent to the weft threads 100 and interconnected by the warp threads 102 if desired.

The strands of material 42 separate from the warp threads 102 at the straight longitudinally extending edge portions of the pockets 46 (see FIG. 9). Thus, the warp threads 102 extend across the outer side of the pocket 46. The strands of material 42 extend across the inner side of the pocket 46. Since the strands 42 are not interconnected by weft threads 100 at the pockets 46, each of the strands is freely movable to a limited extent relative to adjacent strands at the pockets 46. The length of each of the freely movable portions of the strands 42 is equal to the width of a pocket 46 and to the length of the portion of the warp thread 102 which extends across the pocket.

Each of the strands 42 of material extends from one vertical edge of the sheet of fabric 36 to the opposite vertical edge. Thus, the strands 42 have a length which is equal to the length of the warp threads 102. However, the strands of material 42 are allowed to float on the inside of the threads 100 and 102 at the pockets 46 so that the strands of material 42 are separate from the fabric at the pockets. Thus, each strand 42 of material extends across each of the pockets 46 and across each of the panel sections 96 of the fabric sheet 36. It is contemplated that the strands 42 could extend vertically along the sheet of fabric 36 if desired.

In one specific preferred embodiment of the invention, the strands 42 were formed of 5750 denier multiplex nylon cord and had a spacing of 10 ends per inch. In this particular embodiment of the invention the pockets had a width of nine inches. Therefore, each of the strands 42 had a freely movable or floating length of nine inches at each of the pockets 46. It should be understood that the specific size and spacing of the strands 42 of material has been set forth herein for purposes of clarity of illustration and could be varied if desired. It is contemplated that the strands 42 could be weft strands or could be both warp and weft strands. Thus, the strands 42 could be horizontal and/or vertical strands.

Summary

In view of the foregoing it is apparent that the present invention provides a new and improved method of forming cast-in-place concrete structures. The concrete 38 is cast in containers (FIGS. 5 and 6) which are at least partially formed of fabric without providing support structures on the outside of the fabric 36 and without piercing the fabric. The resulting concrete structure 20 is free of exposed metal frame members which provide a path for accelerated corrosive attack on the structure.

When an improved concrete structure 22 is to be cast in accordance with the present invention, support rods 32 are inserted in pockets 46 in a sheet 36 of fabric. The pockets 46 are formed between an inner side surface 64 of the sheet 36 of fabric and strands or elongated pieces of material 42 which extend along the inner side surface of the fabric. The support rods are connected with outer end portions 30 of support elements 28 which extend between the strands 42 of material into the rod receiving pockets 46.

As cementitious slurry 86 is poured into a cavity 68 which is at least partially defined by the sheet 36 of fabric, the slurry flows between the strands 42 of material into the pockets 46. The cementitious slurry 86 presses the sheet 36 of fabric outwardly away from the support rods 32 so that the support rods are surrounded by the slurry. This results in the support rods 32 being enclosed by concrete 38 when the slurry hardens. Since the support rods are enclosed by concrete, they are protected against corrosive attack by seawater and/or other environmental elements.

The strands 42 of material which cooperate with the sheet 36 of fabric to define the rod receiving pockets 46 are advantageously interwoven with the warp threads 102 and weft threads 100 of the sheet of fabric. This results in tension forces which are applied against the strands 42 of material by the support rods 32 being transmitted to a relatively large area of the sheet 36 of fabric. The strands 42 of material extend for a substantial distance along the inner side surface 64 of the sheet 36 of fabric to enable the sheet of fabric to be moved outwardly away from the support rods under the influence of pressure applied against the fabric by the slurry of cementitious material.

Although it is preferred to interweave the strands 42 of material with the threads 100 and 102 of the sheet 36 of fabric, it is contemplated that the strands may be connected to the sheet of fabric without interweaving. In fact, it is contemplated that the strands 42 could be formed as strips which are sewn to the fabric sheet 36.

Having described one specific preferred embodiment of the invention, the following is claimed:

1. A method of casting a concrete structure comprising:

providing a woven fabric form element having a first surface providing a first form surface opposed to a second material providing a second form surface, said woven fabric form element comprising a first set and a second set or perpendicularly related interwoven yarns which extend along first and second dimensions of the woven fabric form element and define said first surface and a corresponding outer surface of the woven fabric form element, one of said yarn sets being the weft of the woven fabric form element and the other being the warp of the woven fabric form element, the interwoven portion of the weft and warp of the fabric having sufficient tensile strength to withstand the hydrostatic pressure applied by a cementitious material and having a weave sufficiently continuous throughout said first surface to confine the cementitious material, a plurality of said first set of yarns extending substantially the extent of said first dimension and floating over a plurality of said second set of yarns at spaced intervals to provide spaced parallel rod receiving means at spaced locations adjacent said first surface of the woven fabric form element each of which extends substantially the extent of said second dimension of said woven fabric form element for receiving a rigid concrete reinforcing and fabric support rod extending substantially the extent of said second dimension of said woven fabric form element for supporting said form element as said first form surface in forming a concrete body, said plurality of first yarns at each of said spaced locations being non-interwoven with said second yarns for a distance sufficient to enable a portion of said interwoven weft and warp of said first surface in said rod receiving means to be pulled away from said plurality of non-interwoven yarns under the influence of the pressure applied against the interwoven warp and weft by the cementitious material to provide a cavity for cementitious material between the support rod in the rod receiving means and the first surface of the woven fabric form element, said plurality of non-interwoven first yarns having a porosity for passing substantial amounts of cementitious material into said cavity in said rod receiving means, and there being a sufficient number of said non-interwoven yarns spaced along the extent of each rod receiving means to support the hydrostatic pressure applied by the cementitious material during the pouring of the concrete body for which said woven fabric form element forms a first form surface, inserting said support rods into said spaced parallel rod receiving means, connecting said support rods to a plurality of support elements projecting outwardly from said second form surface, and flowing a cementitious material between said first and second form surfaces, said step of flowing a cementitious material including flowing the material through said plurality of non-interwoven first yarns into said cavity between said support rod and the first surface of said woven fabric and between free outer end portions of said support elements and said first surface of said woven fabric.

2. A method as set forth in claim 1 wherein said plurality of first yarns which float over a plurality of said second yarns are regularly and closely spaced throughout the extent of each of said rod receiving means.

3. A method as set forth in claim 1 wherein one edge of said fabric element has a pocket means formed therein for receiving the lower ends of said rigid concrete reinforcing and fabric support rod when disposed in said rod receiving means.

4. A method as set forth in claim 3 wherein the dimension of the rod receiving means along the direction of said first set of yarns is approximately equal to the spaced interval between said rod receiving means.

5. A method as set forth in claim 1 wherein the dimension of the rod receiving means along the direction of said first set of yarns is approximately equal to the spaced interval between said rod receiving means.

6. A method as set forth in claim 1 wherein said step of flowing a cementitious material between said first and second form surfaces is performed with the outer surface of said fabric form element free of engagement with support members.

7. A method as set forth in claim 1 further including the step of applying pressure against said first surface of said fabric form element with the cementitious material as the material flows into said cavity to urge said first surface of the fabric form element away from the outer end portions of the support elements and away from the support rods.

8. A method as set forth in claim 1 wherein the fabric form element is free of projections extending through the fabric from the cavity to a space adjacent to the outer surface of said fabric form element.

9. A method as set forth in claim 1 wherein said step of connecting the support rods to the support elements includes the step of inserting outer end portions of the support elements between said plurality of non-interwoven first yarns into said spaced parallel rod receiving means and connecting the support rods with the outer end portions of the support elements in said spaced parallel rod receiving means.

10. A method as set forth in claim 1 wherein said plurality of support elements has outer end portions disposed in a plurality of linear arrays, and said step of connecting the support rods to the support elements includes the step of connecting each of the support rods to one of the linear arrays of support elements.

11. A method as set forth in claim 1 wherein said step of connecting the support rods to the support elements is performed after performance of said step of inserting the support rods into the spaced parallel rod receiving means and includes the step of inserting the outer end portion of each of the support elements into one of the rod receiving means.

* * * * *